US007367837B2

(12) United States Patent
Pabst

(10) Patent No.: US 7,367,837 B2
(45) Date of Patent: May 6, 2008

(54) CONNECTOR FOR FLEXIBLE FLAT STRIP CABLES

(75) Inventor: Thomas Bernhard Pabst, Nuremberg (DE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/533,344

(22) PCT Filed: Oct. 23, 2003

(86) PCT No.: PCT/EP03/11746

§ 371 (c)(1),
(2), (4) Date: Nov. 21, 2005

(87) PCT Pub. No.: WO2004/040706

PCT Pub. Date: May 13, 2004

(65) Prior Publication Data

US 2006/0141853 A1 Jun. 29, 2006

(30) Foreign Application Priority Data

Oct. 31, 2002 (DE) ..... 102 50 934

(51) Int. Cl.
*H01R 13/58* (2006.01)

(52) U.S. Cl. ..... 439/460; 439/452; 439/468; 439/595

(58) Field of Classification Search ..... 439/460, 439/452, 461, 468, 495, 499, 465
See application file for complete search history.

(56) References Cited

U.S. PATENT DOCUMENTS

| | | | | |
|---|---|---|---|---|
| 4,265,507 | A * | 5/1981 | Johnson | 439/495 |
| 4,969,840 | A | 11/1990 | Ii et al. | 439/495 |
| 4,975,076 | A * | 12/1990 | Mosquera | 439/387 |
| 5,370,552 | A * | 12/1994 | Chishima et al. | 439/495 |
| 5,387,123 | A * | 2/1995 | Puerner | 439/460 |
| 5,501,610 | A * | 3/1996 | Ikemoto | 439/498 |
| 5,984,704 | A | 11/1999 | Hashiguchi | 439/260 |
| 6,036,519 | A | 3/2000 | Lopata et al. | 439/260 |
| 6,315,602 | B1 * | 11/2001 | Miura et al. | 439/495 |
| 6,419,501 | B1 | 7/2002 | Okabe et al. | 439/77 |
| 6,773,288 | B2 * | 8/2004 | Geltsch et al. | 439/329 |
| 2004/0043655 | A1 * | 3/2004 | Godefroy et al. | 439/460 |

FOREIGN PATENT DOCUMENTS

| | | | |
|---|---|---|---|
| DE | 196 33 933 | A1 | 4/1998 |
| EP | 0302452 | A1 | 2/1989 |
| EP | 0 445 973 | A1 | 9/1991 |
| EP | 0 706 241 | A2 | 4/1996 |
| EP | 1248321 | A1 | 10/2002 |
| EP | 1248321 | B1 | 8/2004 |
| EP | 1 195 852 | B1 | 12/2004 |

* cited by examiner

*Primary Examiner*—Hien Vu
(74) *Attorney, Agent, or Firm*—Harrington & Smith, PC

(57) ABSTRACT

The present invention relates to a connector (1) for flat flex cables (2), with a housing (3), in which is provided: at least one introduction opening (4) for one end of a flat flex cable, spring contacts (5) for connecting the at least one flat flex cable (2) with contacts (6) or with another flat flex cable (7) and at least one strain relief (8). The strain relief (8) has a slide (9), which is introduced into the introduction opening (4) above the flat flex cable (2), the flat flex cable (2) being bent by a rib (10) on slide (9) into a recess (11) in the bottom of introduction opening (4) until the slide (9) locks into its final position on housing (3).

18 Claims, 5 Drawing Sheets

CONNECTOR FOR FLEXIBLE FLAT STRIP CABLES

FIELD OF THE INVENTION

The present invention concerns connectors for flat flex cables according to the preamble of patent claim 1.

BACKGROUND OF THE INVENTION

Such a connector is known, for example, from GB-1,317,264 B1. The connector described therein has, in a housing, spring contacts which are pressed against regions of the flat flex cable that are stripped of insulation, while the opposite-lying ends of these spring contacts are in the shape of female connectors for the uptake of male connectors. The connection of two flat flex cables with one another is carried out by direct contact of the parts of the flat flex cable that are stripped of insulation. The overall structure of the connector described therein has proven to be complicated with respect to its handling and an effective strain relief cannot be recognized.

SUMMARY OF THE INVENTION

The object of the present invention is to extensively improve a connector of this type such that its handling is simplified and a secure strain relief is continually assured in the case of the flat flex cables that participate in it.

This object is solved according to the claims.

Features of preferred embodiments of the present invention are characterized in the subclaims. The concept of the invention is based on the following: when the connector is introduced into its final position, the one or more flat flex cables that participate in it are clamped into a "baffle plate", in which the cables are very sharply bent locally, so that the adhesion friction forces that occur in the strain loading are so great that a tearing out of the flat flex cable from the connector can be effectively prevented. The operator who assembles the connector recognizes the obtaining of the final position by the "clicking in" of the connector elements.

BRIEF DESCRIPTION OF THE DRAWINGS

In the following, the invention will be explained in more detail based on the description of three embodiments of the present invention with reference to the drawing. The following are shown therein.

DETAILED DESCRIPTION OF THE INVENTION

Figure 1:
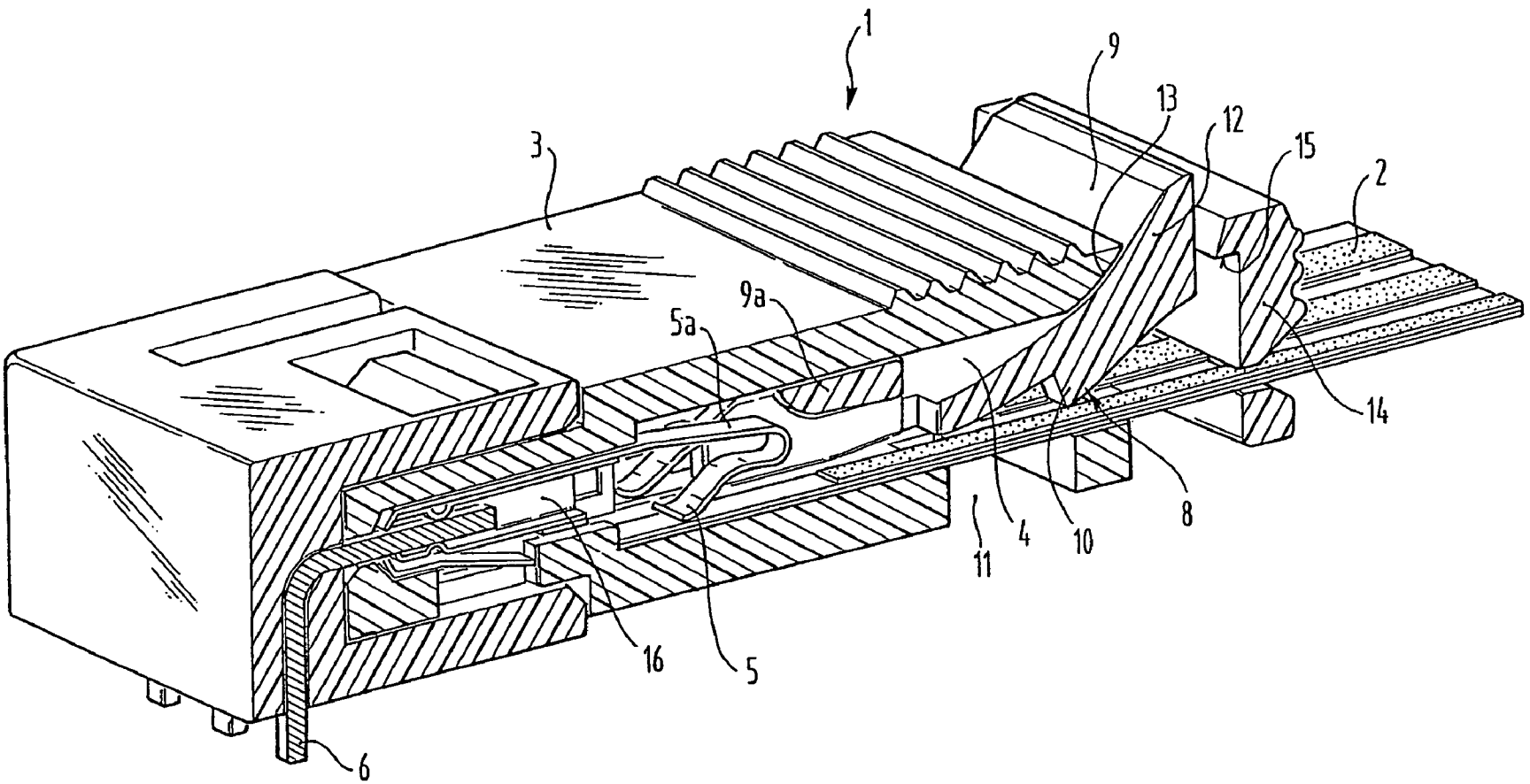
FIG. 1 shows a perspective view, which is partially cut away, of a first embodiment of the connector according to the invention.
Figure 2A:
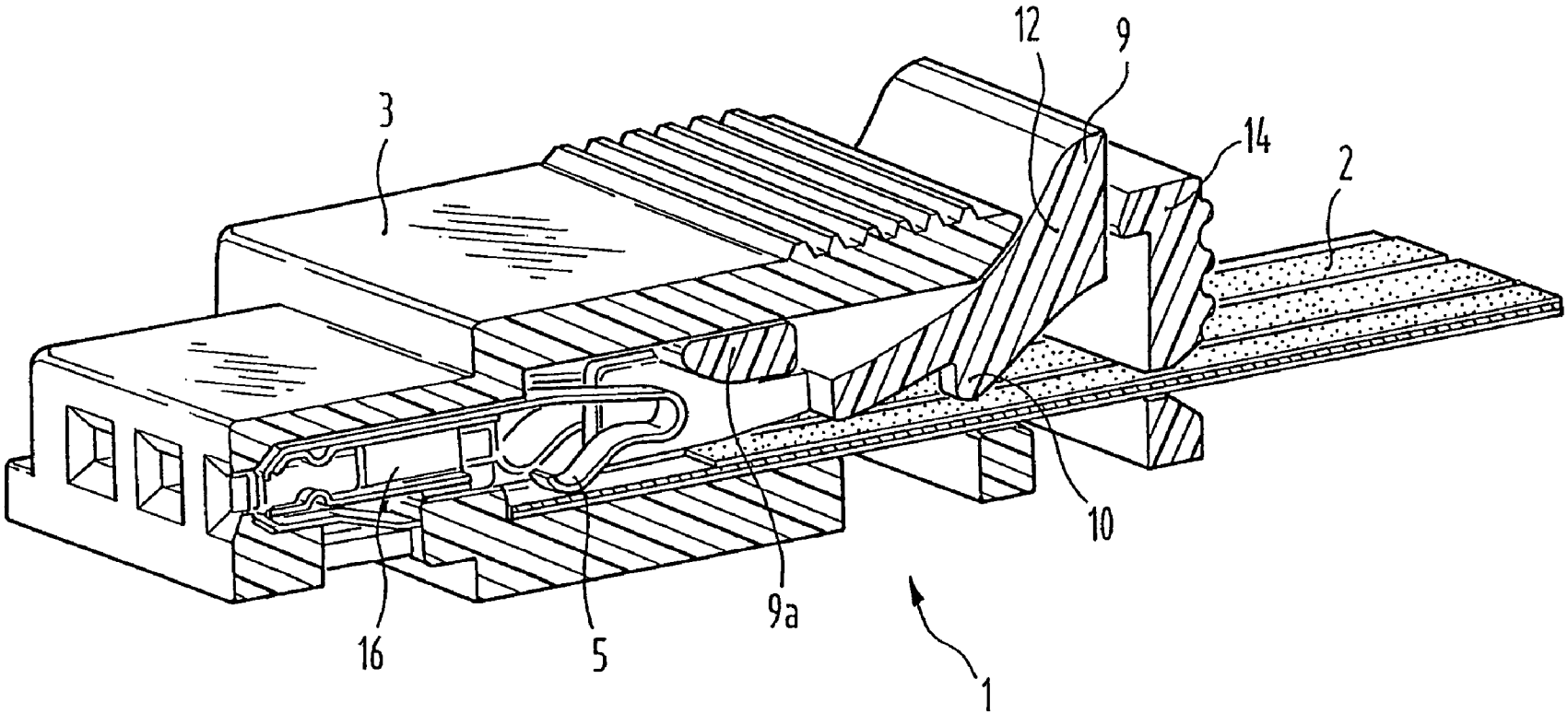
FIG. 2 shows the connector according to FIG. 1 in the pre-locking position and in the final position.
Figure 2B:
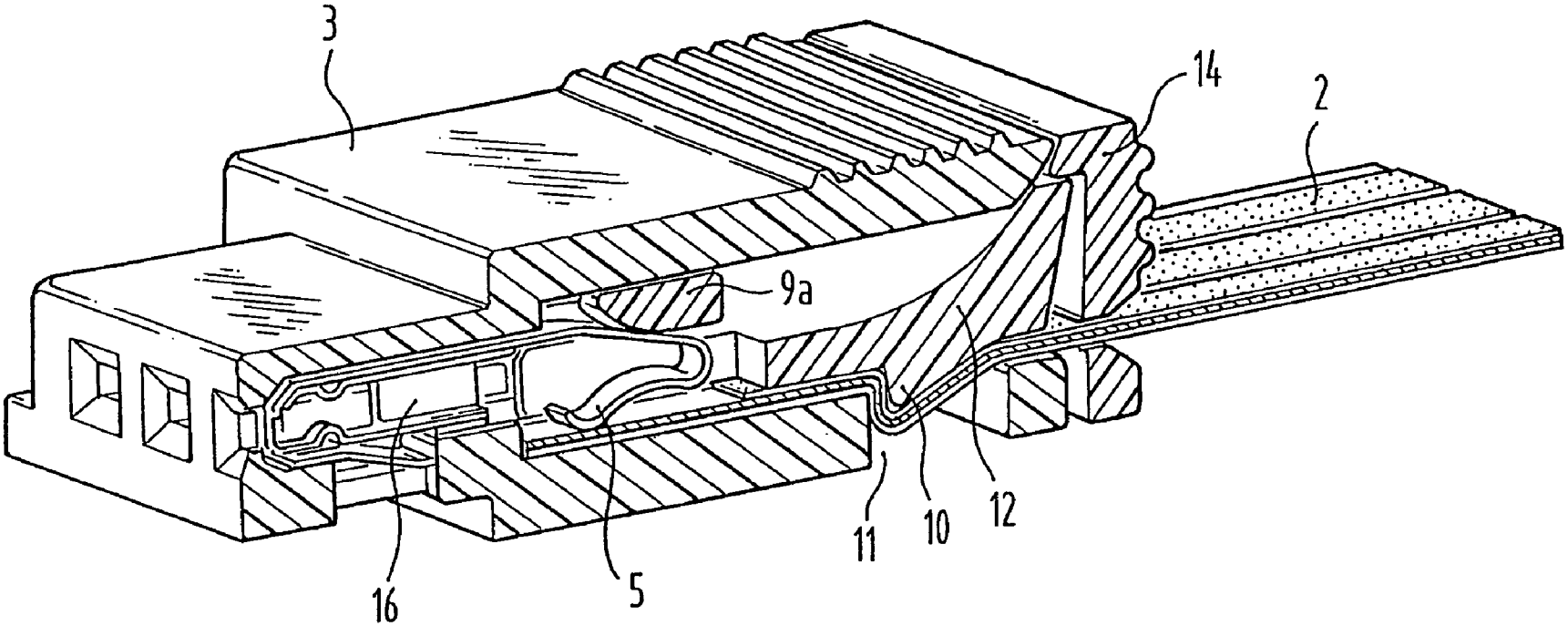

The connector 1 shown in FIG. 1 has a housing 3, with an introduction opening 4 for a flat flex cable 2. The latter is inserted into the introduction opening 4 until it strikes the end of the opening. At its head end, the flat flex cable 2 has conductive tracks stripped of insulation, onto which press the spring contacts 5. In addition to the flat flex cable 2, a slide 9, which has several functions, is introduced into the introduction opening 4. First of all, it effects a strain relief of the flat flex cable 2, which is described in more detail below, and secondly, it presses the spring contacts 5 more strongly onto the conductive tracks of the flat flex cable 2, which are stripped of insulation. The strain relief is effected by a ramp 12 at the back end of the slide, viewed in the insertion direction, which, with its back end, projects up over the introduction opening 4, when it is in the position prior to assembly. On its bottom side, ramp 12 has a rib 10 running crosswise to the insertion direction. In the final locked position, this rib 10 lies opposite a recess 11 or a passage 11 in the bottom of housing 3. In addition, the slide 9 has on its end an operating surface 14 with a gap, through which the flat flex cable 2 is conducted. The operating surface 14 serves as the surface for an operator to introduce force by pressing on the operating surface in the insertion direction, until the slide 9 locks into its final position. On the way to this final position, ramp 12 is pressed downward through the upper edge of the introduction opening 4, so that the cross-rib 10 presses the flat flex cable 2 into the recess or into the passage 11. The pre-locking position and the final position are shown in FIG. 2. It can be clearly recognized in FIG. 2*b* that the cross rib 10, in its final position, comes to lie tightly at the front edge of the recess or opening 11, viewed in the insertion direction, so that the flat flex cable 2 experiences an almost 90-degree bend, which represents an effective strain relief.

In final position, the upper back edge of the slide 9 locks under a shoulder 15, which is provided in the operating surface 14.

In the region of its head end, slide 9 also has an additional two ramps 9*a*, which, when slide 9 is inserted into the introduction opening 4, press the legs 5*a* situated at the ends of pressure springs 5 located away from flat flex cable 2 and press the entire essentially U-shaped spring contacts 5 in the direction onto the flat flex cable 2. In this way, a more stable and more secure electrical contact is assured between the contact springs 5 and the conductive tracks of the flat flex cable 2, which are stripped of insulation.

In the embodiments shown in FIGS. 1 and 2, the spring contacts 5 have contact sockets 16 at their sides that are not in contact with the flat flex cable 2, which are arrested in corresponding openings in the housing 3, for contacting the flat flex cable 2 with male connectors of a complementary connector.

Figure 3:
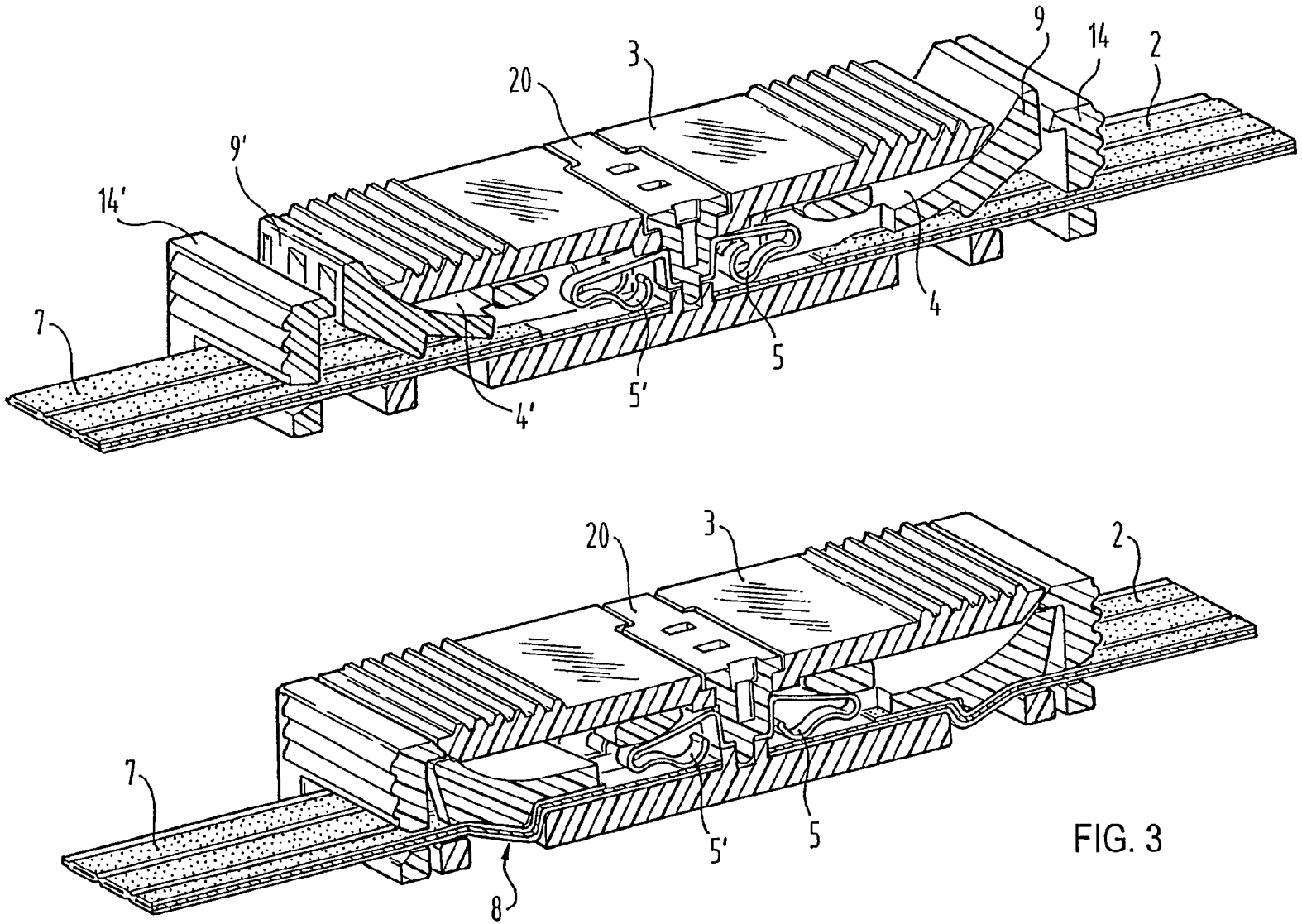
FIG. 3 shows another embodiment of the present invention in the pre-locking position and in the final locked position.

FIG. 3 shows an embodiment of a connector according to the invention, with which two flat flex cables 2, 7 can be connected with one another. FIG. 3 shows the pre-locking position (upper left) and the final locked position (lower right). As can be readily seen, the structure of this connector differs from that shown in FIGS. 1 and 2 only by the fact that a mirror-symmetric doubling has occurred, with two anti-parallel introduction openings 4, 4' in a housing 3 and with spring contacts 5, 5', whose back ends are joined together, or which are made up in one piece from the outset. The strain relief function and the pressing of spring contacts 5, 5' onto the parts of flat flex cables 2, 7 which are stripped of insulation are described identically to those with reference to FIGS. 1 and 2. The spring contacts 5, 5' in this embodiment are fastened by means of an arresting part 25 that can be introduced crosswise to the insertion direction on housing 3 in a way known in and of itself. That is, there results a fixing of position in the locked final position of arresting part 25 in housing 3.

Figure 4:
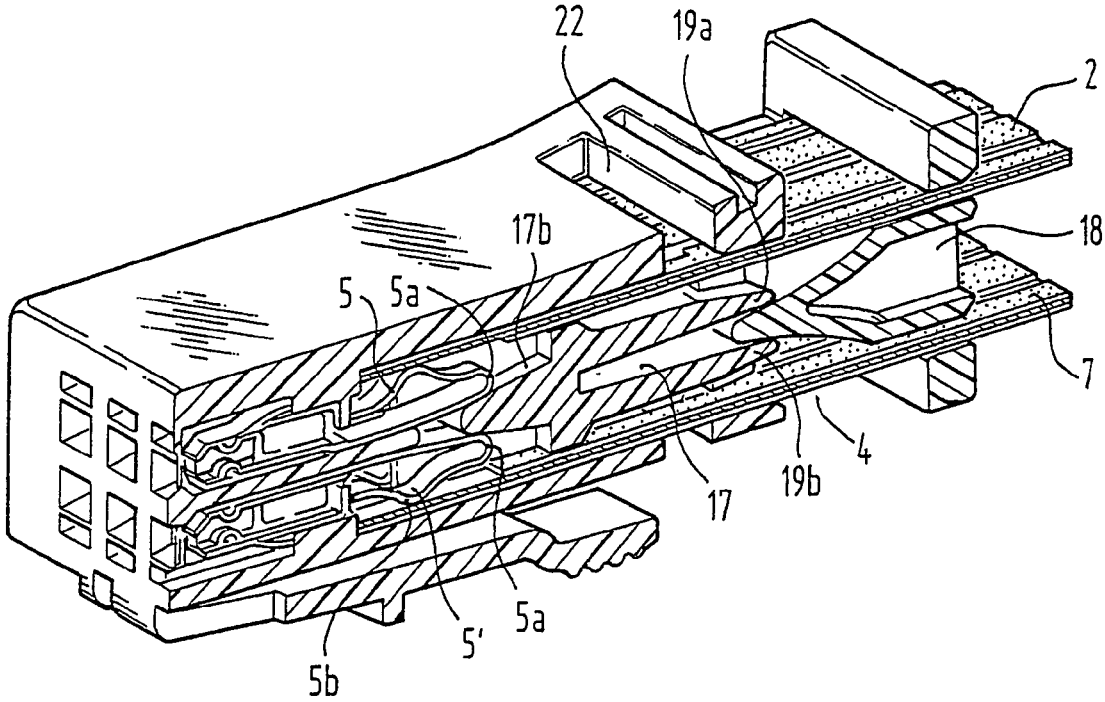
FIG. 4 shows a third embodiment of a connector according to the present invention in perspective view, which is partially cut away, in the pre-locking position and in the final locked position.
Figure 4:
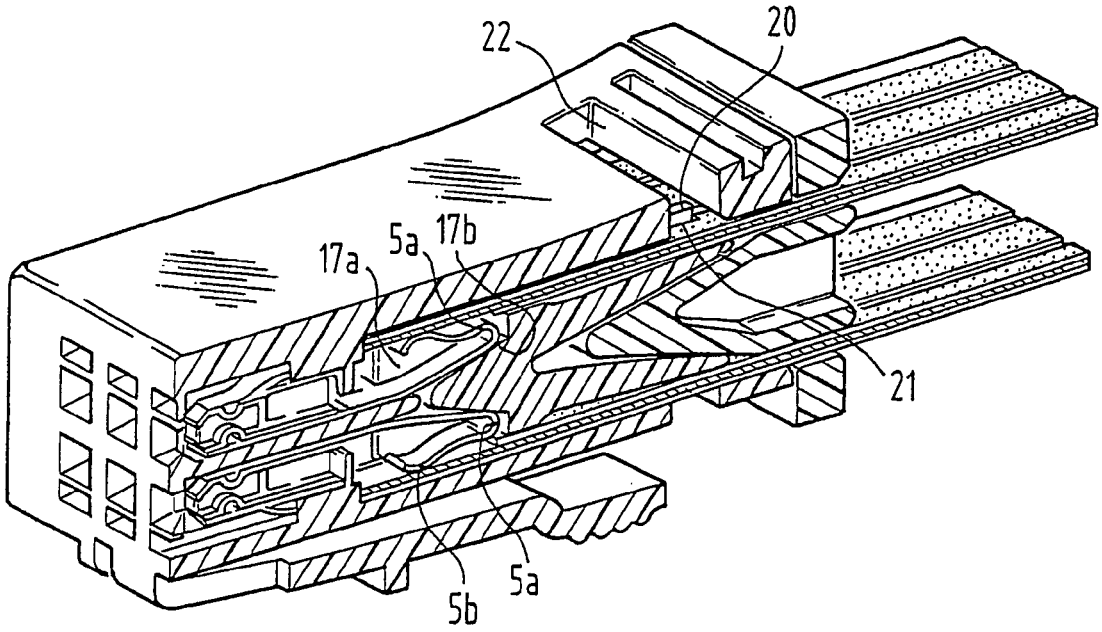

FIG. 4 shows a third embodiment of a connector according to the invention, in which two flat flex cables 2, 7 can be inserted into introduction opening 4 and push onto two rows of spring contacts 5, 5' which are disposed in a mirror-symmetric manner and each of which is formed in just the same way as in the first embodiment. In distinction to the first embodiment, here the two flat flex cables 2, 7 are guided by means of an intermediate member 17 and a slide 18 connecting thereto and fastened. On its head end, the intermediate member 17 has shoulders, with which the legs 5*b* of the spring contacts which are adjacent to the conductive tracks are pressed onto the conductive tracks. The intermediate member 17 is slotted on its back end along a central plane parallel to the extension of the flat cable. The wedge-shaped tip of slider 18 engages in this slot, so that the back end of the intermediate member 17 is propped open and thus the flat flex cables 2, 7 press against the inner walls of the introduction opening 4.

Here, at the back ends of the slotted parts of the intermediate member, strain relief projections 20 are provided, which engage in corresponding openings 21, which are punched at the appropriate distance in the sides of the flat flex cables. The projections thus pass through the openings in flat flex cables 2, 7 and enter cross slots 22, which are also incorporated at this level in housing 3. The slide 18 is locked in its final position on housing 3 in a way known in and of itself, so that both a high pressing force of the contact springs as well as a secure strain relief are assured.

In the example of embodiment shown in FIG. 4, contact sockets are also formed at the other ends on spring contacts 5. This is not to be understood as limiting, however; contact pins or even contact springs for connecting several flat flex cables 2, 7, as in the second example of embodiment, could just as well be arranged.

The three embodiment examples explained above show the broad field of application of the present invention, wherein the description of the embodiment examples also only serves for purposes of illustration and is not to be construed as limiting.

The invention claimed is:

1. A connector for at least one flat flex cable comprising:

a housing comprising a top wall and at least one introduction opening for a flat flex cable end, spring contacts connected to the housing for connecting the at least one flat flex cable with contacts or another flat flex cable, and at least one strain relief, wherein the strain relief has a slide, which is sized and shaped to be introduced into the introduction opening over the flat flex cable in a direction at least partially along an introduction direction of the flat flex cable into the introduction opening, wherein the flat flex cable is bent by a rib on the slide into a recess at a bottom of the housing proximate the introduction opening until the slide locks in a final position on the housing, further characterized in that the slide forms a ramp, whose back end projects above the top wall and a level of the opening during introduction into the opening and slides on the upper edge of the introduction opening, whereby the rib is pressed into the recess, and wherein the slide has a section, on a back end of the slide, with an operating surface for pressing the slide therein.

2. The connector according to claim 1, wherein the slide comprises a shoulder for locking the ramp.

3. The connector according to claim 1, further characterized in that the spring contacts, at a head end of the introduction opening, are prestressed perpendicular to longitudinal axis press on regions of conductive tracks of the flat flex cable that are stripped of insulation.

4. The connector according to claim 3, further characterized in that the spring contacts are essentially bent in U-shape and comprise legs which are pressed onto the flat flex cable by two ramps on the slide.

5. The connector according to claim 3, further characterized in that the spring contacts are formed with ends pointing away from the introduction opening as female connectors or plug contacts.

6. The connector according to claim 3, further characterized in that the spring contacts are bent in U-shape at both of their ends and two introduction openings are disposed with their head ends abutting one another in housing for connecting two flat flex cables.

7. The connector according to claim 1, further characterized in that the introduction opening takes up two flat flex cables, and two rows of spring contacts are provided one above the other.

8. The connector according to claim 7, further characterized in that the spring contacts are held by an intermediate member in the introduction opening, and this member can be moved to the head end of the introduction opening by a slider and can be propped open at its back ends, in order to press strain relief projections disposed therein into corresponding openings punched in the flat flex cables.

9. The connector according to claim 8, further characterized in that at the level of openings in the flat flex cables, housing has slots, into which the strain relief projections of intermediate member can be moved.

10. The connector according to claim 7, further characterized in that the spring contacts are bent convexly at their legs that can be pressed onto flat flex cables and are pressed by shoulders of intermediate member onto the flat flex cables.

11. The connector according to claim 10, further characterized in that on its head end, the intermediate member has ramps, with which the legs of spring contacts located away from the flat flex cables are to be pressed onto the flat flex cables.

12. The connector according to claim 7, further characterized in that the slide can be locked in its final position on housing.

13. The connector according to claim 1 wherein the introduction opening comprises a slot into a rear end of the housing, wherein the strain relief is inserted into the slot through the rear end of the housing.

14. The connector according to claim 1 wherein the strain relief comprises a slot adapted to receive the end of the flat flex cable.

15. A connector for a flat flex cable comprising:

a housing comprising an opening adapted to receive an end of the flat flex cable;

spring contacts connected to the housing, wherein the spring contacts are adapted to connect to electrical conductors of the flat flex cable; and at least one strain relief connected to the housing, wherein the strain relief comprises a slide extending through the opening, wherein the strain relief comprises a slot adapted to have the end of the flat flex cable pass therethrough, wherein the slide comprises a rib, and wherein the flat flex cable is bent by the rib on the slide which is pushed inwardly at a rear end of the housing into a recess of the housing when the slide is locked into a final position on the housing, wherein the slide comprises a ramp having a rear end extending above the housing adapted to contact the housing and adapted to move the slide in a second direction when the strain relief is moved in a first direction inward into the rear side of the housing.

16. A connector for a flat flex cable comprising:

a housing comprising an rear side having a slot adapted to receive an end of the flat flex cable;

spring contacts connected to the housing, wherein the spring contacts are adapted to connect to electrical conductors of the flat flex cable; and at least one strain relief extending into the rear side of the housing at the slot, wherein the strain relief is movably connected to the housing such that the strain relief is adapted to be pushed inward into the rear side of the housing, wherein the strain relief comprises a slide having a rib, and wherein the rib is adapted to bend the flat flex cable into a recess of the housing when the slide is slid through the rear side of the housing into the slot, wherein the slide comprises a ramp having a rear end extending above the housing adapted to contact the housing and adapted to move the slide in a second direction when the strain relief is moved in a first direction inward into the rear side of the housing.

17. The connector according to claim 16, wherein the strain relief comprises a slot adapted to pass the end of the flat flex cable therethrough.

18. The connector according to claim 16, wherein the strain relieve comprises a latch for latching the slide in a final position on the strain relief.

* * * * *